US005905219A

United States Patent [19]

Westheimer

[11] Patent Number: 5,905,219

[45] **Date of Patent: *May 18, 1999**

[54] STRINGED MUSICAL INSTRUMENT BODY AND NECK COMPOSITION AND METHOD OF MAKING BODY AND NECK

[76] Inventor: Jack L. Westheimer, 3451 W. Commercial Ave., Northbrook, Ill. 60062

[ * ] Notice: This patent issued on a continued prosecution application filed under 37 CFR 1.53(d), and is subject to the twenty year patent term provisions of 35 U.S.C. 154(a)(2).

[21] Appl. No.: 08/588,572

[22] Filed: Jan. 17, 1996

[51] Int. Cl.[6] ..... G10D 3/00

[52] U.S. Cl. ..... 84/452 P; 84/452 R

[58] Field of Search ..... 84/291, 293, 452 P, 84/452 R

[56] References Cited

U.S. PATENT DOCUMENTS

| | | | |
|---|---|---|---|
| 3,691,285 | 9/1972 | Larrison | 84/1.16 |
| 3,869,955 | 3/1975 | Yamaguchi | 84/452 P |
| 3,911,778 | 10/1975 | Martin | 84/267 |
| 4,088,050 | 5/1978 | Appel | 84/267 |
| 4,090,427 | 5/1978 | Kaman | 84/291 |
| 4,119,009 | 10/1978 | Kaman, II | 84/293 |
| 4,144,793 | 3/1979 | Soika et al. | 84/291 |
| 4,185,534 | 1/1980 | Cove | 84/291 |
| 4,188,850 | 2/1980 | Kaman, II | 84/291 |
| 4,213,370 | 7/1980 | Jones | 84/291 |
| 4,290,336 | 9/1981 | Peavey | 84/291 |
| 4,313,362 | 2/1982 | Lieber | 84/267 |
| 4,334,452 | 6/1982 | Morrison, III et al. | 84/1.16 |
| 4,364,990 | 12/1982 | Haines | 84/452 P |
| 4,442,236 | 4/1984 | Rasshofer et al. | 521/130 |
| 4,450,748 | 5/1984 | Shaw et al. | 84/291 |
| 4,868,224 | 9/1989 | Harasin et al. | 521/124 |
| 4,969,381 | 11/1990 | Decker, Jr. et al. | 84/291 |
| 5,054,356 | 10/1991 | Farnell, Jr. | 84/291 |
| 5,069,964 | 12/1991 | Tolliver et al. | 428/325 |

*Primary Examiner*—William M. Shoop, Jr.
*Assistant Examiner*—Shih-yung Hsieh
*Attorney, Agent, or Firm*—Friscia & Nussbaum

[57] ABSTRACT

A composition and method of making bodies and necks for stringed musical instruments is provided. The composition is basically an unsaturated compound poly-urethan resin and an inorganic filler, or components comparable thereto, which are combined with a hardener and then molded to form a guitar body, neck or other component of a stringed instrument. The method of making a body or neck of the present invention generally includes the steps of preparing the composition mixture, adding a hardener to the mixture, delivering the mixture and hardener to a mold, and molding the composition. Various appropriate actions may be undertaken upon completion of the molding process including machining, finishing, etc., although the molding process tends to obviate the need for further machining.

12 Claims, No Drawings

STRINGED MUSICAL INSTRUMENT BODY AND NECK COMPOSITION AND METHOD OF MAKING BODY AND NECK

BACKGROUND OF THE INVENTION

1. Field of the Invention

This invention generally relates to a composition for a stringed musical instrument body and/or neck and a method of making a stringed instrument body and/or neck from such a composition, and more specifically to a guitar body manufactured from a composition possessing qualities similar to those of wood body guitars.

2. Related Art

In the past, stringed instrument bodies, particularly guitar bodies, have been made of wood stock material. Generally, expensive wood is used and it must be dried prior to use. Blocks of the wood as a whole or in part are assembled into a desired configuration and thereafter machined to a final shape. Various recesses are also machined into the body to accommodate necessary components. Necks for such guitar bodies are also generally fabricated from wood stock.

There are a number of drawbacks, however, associated with conventional wood bodies and necks. One such drawback is that the wood stock is expensive. This adds cost to the end product. Additionally, because of various naturally occurring deformities in the wood stock, many blocks of wood are frequently discarded. This further adds to the cost of the end product. Additionally, machining the wood is a time and labor intensive operation which even further adds to the cost of the end product. Finally, inconsistencies in the wood, such as knots, result in uneven sound qualities and unwanted or dampened resonances.

What is needed, and has not heretofore been developed, is a guitar body that can be molded from synthetic materials, and which simulates a wood guitar body in terms of sound, weight, feel, look, etc. Also, it would be important to develop a guitar body having uniform sound qualities associated therewith. Additionally, it would be desirable to develop a simple and inexpensive method for manufacturing such a guitar body. However, it would also be important to maintain the rich sound quality of wood.

There have been numerous attempts in the past to overcome the drawbacks associated with wood guitar bodies. One example of such an attempt is disclosed in U.S. Pat. No. 4,290,336 to Peavey dated Sep. 22, 1981. This patent is directed to a guitar neck and body made at least in part of moldable materials. In one embodiment disclosed in the patent, moldable materials may be positioned about a core material such as wood. In another embodiment disclosed in the patent, the guitar body is made up of a clam shell type construction, i.e. two opposite halves are formed and then joined together.

Another attempt to overcome the problems associated with wood body guitars is disclosed in U.S. Pat. No. 4,119,009 to Kaman, II dated Oct. 10, 1978. This patent is directed to a guitar having a neck comprised of structural foamed plastic surrounding a frame.

Likewise, U.S. Pat. No. 3,911,778 to Martin dated Oct. 1975, discloses a neck for a guitar comprising a metallic frame combined with structural foamed plastic.

However, these patents do not overcome all of the drawbacks associated with wood guitar bodies in that the sound qualities of the bodies are not entirely uniform, assembly of the components of the bodies and the necks takes time and money, and the wood-like quality of the body is not maintained. Specifically, these prior efforts include bodies having component parts and do not undertake to provide a unitary body. Further, the highly desirable sound quality of wood is not maintained.

None of these previous efforts in this field disclose all of the benefits and advantages of the present invention, nor do any of the previous efforts teach or suggest all of the elements of the present invention.

OBJECTS AND SUMMARY OF THE INVENTION

It is a primary object of the present invention to provide a composition for a body of a stringed musical instrument.

It is another object of the present invention to provide a composition for a neck of a stringed musical instrument.

It is another object of the present invention to provide a composition for a body and/or neck of a guitar.

It is even another object of the present invention to provide a composition for a stringed musical instrument which simulates a wood stringed musical instrument.

It is even another object of the present invention to provide a composition for a stringed musical instrument which provides tonal qualities similar to those of wood.

It is still even another object of the present invention to provide a composition for a stringed musical instrument which has a density that approximates the density of wood.

It is still even another object of the present invention to provide a composition for a stringed musical instrument which can be finished to give the appearance of wood.

It is yet another object of the present invention to provide a composition for a stringed musical instrument which provides uniform sound qualities.

It is yet another object of the present invention to provide a composition for a stringed musical instrument which minimizes unwanted resonances.

It is still yet another object of the present invention to provide a composition for a stringed musical instrument which minimizes waste material associated with rejected wood blanks.

It is still yet another object of the present invention to provide a composition for a stringed musical instrument which is relatively strong.

It is a further object of the present invention to provide a composition for a stringed musical instrument which is relatively impervious to temperature changes.

It is even a further object of the present invention to provide a composition for a stringed musical instrument which is relatively inexpensive.

It is another object of the present invention to provide a method for making a stringed musical instrument from a composition heretofore not used for making stringed musical instruments.

It is another object of the present invention to provide a method for making a stringed musical instrument from a composition which is relatively inexpensive.

It is even another object of the present invention to provide a method for making a stringed musical instrument from a composition which results a stringed musical instrument having a wood appearance.

It is even another object of the present invention to provide a method for making a stringed musical instrument from a composition which results in a stringed musical instrument having a wood-like sound and feel.

It is yet another object of the present invention to provide a method for making a stringed musical instrument from a composition which minimizes waste by minimizing the machining necessary to arrive at an end product.

It is another object of the present invention to provide a method for manufacturing a stringed musical instrument which uses a mold approximating an end product to reduce the amount of machining to arrive the end product.

These and other objects are achieved by the stringed musical instrument body and neck composition and method of making body and neck of the present invention. The composition for the stringed musical instrument body of the present invention comprises an unsaturated compound polyurethane resin and an inorganic filler, or components comparable thereto, which are combined with a hardener and then molded to form a body, neck or other component of a stringed musical instrument.

The method of making body and neck of the present invention generally comprises the steps of preparing the composition mixture, adding a hardener to the mixture, delivering the mixture and hardener to a mold, and molding the composition. Various appropriate actions may be undertaken upon completion of the molding process including machining, finishing, etc. However, it is an important feature of the invention that the molding process tends to obviate the need for machining.

Other important objects and features of the invention will be apparent from the following Detailed Description of the Invention.

DETAILED DESCRIPTION OF THE INVENTION

The present invention is directed to a stringed musical instrument body and neck composition and method of making body and neck. As shown in FIG. 1, a stringed musical instrument 10 includes a body 12 and a neck 14. It should preliminarily be noted that the compositions and materials, as well as the methods described herein, can be equally applied to the manufacture of a guitar, violin or any other stringed musical instruments and/or components thereof including the neck of such an instrument.

Generally, the composition for making guitar body comprises an unsaturated compound polyurethane resin and an inorganic filler material such as polyester balloon or glass bubble (such as K-1 from 3M Company). It is important to remember that it is desirable to approximate the characteristics of wood, and accordingly it desirable to approximate the specific gravity of wood through the composition. In the present case, the urethan resin has a specific gravity of approximately 1.03 and the filler has a specific gravity of approximately as low as approximately 0.125. Accordingly, when mixed together, the resulting composition has a specific gravity of approximately 0.45 to 0.6, which is similar to the specific gravity of wood. This results in an instrument which feels like wood, looks like wood and even sounds like wood. Additionally, the wood-like density of the composition produces an excellent sustain which is a highly desired feature. Further an instrument made from this composition can be machined and finished like wood, i.e. the instrument can be coated with a lacquer or other coating to give the appearance of wood under such a coating. In the past, only solid colors, generally black, were obtainable on composite guitar bodies because of the their carbon content. It should be noted that it may even be possible to add color to the molded composition by means of adding a coloring agent to the mixture of ingredients or even by adding gel coats or other such coloring agents to the mold or mold separator in which the composition is to be molded.

After the urethan and filler ingredients are mixed, a hardener is added to the composition and then the entire composition is delivered into a mold such as a Silicon mold to be formed into the desired shape. Alternatively, it is within the scope of the present invention to use molds of any suitable material including, but not limited to, latex molds, fiberglass molds and/or aluminum molds (which could be polished or plated or otherwise). Further, such molds could have varying surfaces to obtain desired effects in the end product.

The combination of urethan and an inorganic filler results in an end product that is impervious to moisture and/or temperature changes. Typically, conventional guitars must be adjusted to account for moisture and/or temperature changes and to maintain proper sound quality. However, the composition of the present invention results in an instrument body that once manufactured requires very little, if any, further adjustment to account for moisture and/or temperature changes. This is a highly desirable feature for instrument manufacturers.

In a preferred embodiment of the present invention, the composition comprises the following ingredients in the following amounts:

| Ingredient | Amount |
|---|---|
| 1. AMINE BASED POLYOL NO-300 OH VALUE | 21.5 PART. |
| 2. POLYPROPYLENE GLYCOL P.P750 OH VALUE 145–155 | 21.5 PART. |
| 3. VISCOSITY CONTROL AGENT (CYCRO PENTHANE) | 20–25 PART. |
| 4. FILLER (FILLITE OR MICROCELL) | 5–20 PART. |
| and/or SCOTCHLITE K-1 GLASS BUBBLE | 20 PART. |
| 5. M.D.I. (4.4-DIPHEA YL METHANE ISOCYANATE) | 48 PART. |

Of course it should be noted that variations of the composition are considered within the scope of the present invention. Further, other ingredients may be used or substituted for those ingredients set forth above. Likewise, similar materials may be substituted for given materials as is known in the art.

With respect to the method of the present invention, the various ingredients comprising the composition are mixed together in tanks. Thereafter, the mixed ingredients are delivered to a gun where the accelerator is added to the mixed ingredients. Next, the composition is poured into the mold and allowed to expand to fill the mold. Next, the composition is removed from the mold and may be machined. Thereafter, the machined composition is fitted with any necessary and/or desirable components and assembled to a create a final product. Additionally, the composition may be finished in accordance with what is known and practiced in the art.

It should be pointed out that different body shapes and thicknesses may require variations in the composition. Also, different effects can be achieved through varying the components. Accordingly, the tonal qualities of an instrument can be varied by varying the components and/or quantities of the composition. Further, new sound qualities heretofore not obtainable with conventional wood instrument bodies can be achieved by varying the components and/or quantities of the composition. For example, a light body could be obtained by increasing the amount of filler in the composition to vary the weight of the end product. Accordingly, custom guitar bodies could be manufactured for various types of playing styles and/or to create specific effects, i.e. a light-weight body for high, top-end treble sounds.

Additional advantages of the present invention include the ability to fabricate instrument bodies on a mass production basis. Further, the molded composition results in relatively clean surfaces that require little or no machining and/or finishing to arrive at a finished product. This tends to further allow the instrument bodies to be mass produced without sacrificing quality, and also allows for the manufacture of instruments on a relatively inexpensive basis. Also, there is relatively little waste associated with the method of making the instrument bodies. Additionally, from an environmental view, using materials other than wood creates a positive impact associated with conserving forests.

Having thus described the invention in detail, it is to be understood that the foregoing description is not intended to limit the spirit and scope thereof. What is desired to be protected by Letters Patent is set forth in the appended claims.

What is claimed is:

1. A polymeric stringed musical instrument body and neck comprising an unsaturated compound polyurethane resin and an inorganic filler material, the musical instrument body and neck each being formed as respective single unitary structures composed solely of said unsaturated compound polyurethane resin and inorganic filler material.

2. The instrument of claim 1 wherein the inorganic filler material comprises polyester balloon.

3. The instrument of claim 1 wherein the inorganic filler material comprises glass bubble.

4. The instrument of claim 1 wherein the instrument has a specific gravity similar to the specific gravity of wood.

5. The instrument of claim 4 wherein the specific gravity of the polyurethane resin is approximately 1.03 and the specific gravity of the filler is approximately 0.125.

6. The instrument of claim 5 wherein the specific gravity of the instrument is approximately 1.03.

7. A polymeric stringed musical instrument body and neck comprising an amine based polyol and polypropylene glycol, the musical instrument body and neck each being formed as respective single unitary structures composed solely of said amine based polyol and polypropylene glycol.

8. The instrument of claim 7 further comprising a filler.

9. The instrument of claim 8 further comprising cycropenthane.

10. The instrument of claim 9 further comprising methane isocyanate.

11. The instrument of claim 1 further comprising a coloring agent.

12. The instrument of claim 7 further comprising a coloring agent.

* * * * *